United States Patent [19]

Godinet

[11] Patent Number: 4,719,656

[45] Date of Patent: Jan. 19, 1988

[54] BED AND MATTRESS FORMED BY ANIMAL SHAPED NESTING PLAY CUSHIONS

[76] Inventor: Wayne P. Godinet, 1717 Kraft St., Oceanside, Calif. 92054

[21] Appl. No.: 397,492

[22] Filed: Jul. 12, 1982

[51] Int. Cl.[4] ..... A63H 33/04; A47C 31/02

[52] U.S. Cl. ..... 5/401; 446/69; 446/268; 273/157 R

[58] Field of Search ..... 5/465, 401, 400, 437, 5/455; 446/69, 268; D6/201, 202, 203, 204; 273/157 R; D21/107, 104

[56] References Cited

U.S. PATENT DOCUMENTS

| | | | |
|---|---|---|---|
| D. 79,576 | 10/1929 | Scovell | D6/203 |
| D. 243,736 | 3/1977 | Ishizuka | D6/203 |
| D. 270,800 | 10/1883 | Fuller | D6/201 |
| 941,680 | 11/1909 | Houghton | 273/157 R |
| 1,208,277 | 12/1916 | Billow | 5/490 |
| 1,276,361 | 8/1918 | Hobert | 5/465 |
| 3,613,133 | 10/1971 | Isola et al. | 5/482 |
| 4,052,072 | 10/1977 | Beal | 273/157 R |
| 4,092,752 | 6/1978 | Dougan | 5/400 |
| 4,109,887 | 8/1978 | Wakeland | 5/400 |
| 4,197,602 | 4/1980 | Johenning | 5/411 |
| 4,281,425 | 8/1981 | Jacobs | 5/455 |
| 4,364,134 | 12/1982 | Marks | 5/201 |

*Primary Examiner*—Gary L. Smith
*Assistant Examiner*—Vinh Luong
*Attorney, Agent, or Firm*—Duane C. Bowen

[57] ABSTRACT

A bed having a horizontal supporting body and vertical side frames and a rectangular mattress resting on the body and fitting between the frames, the mattress being formed by a multiplicity of individually removable juxtaposed pillows, each pillow in plan view forming a meaningful symbol such as an animal and the pillows having covers representatively colored and decorated to represent the symbols, the upper surface of the supporting body having markings outlining the designed arrangement of the pillows, and a matching spread used over the mattress.

6 Claims, 17 Drawing Figures

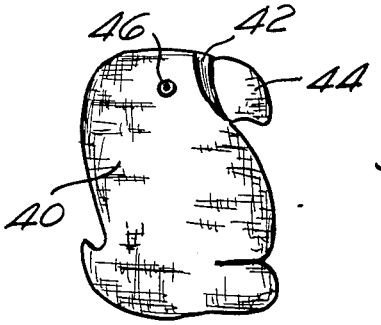
Fig. 5
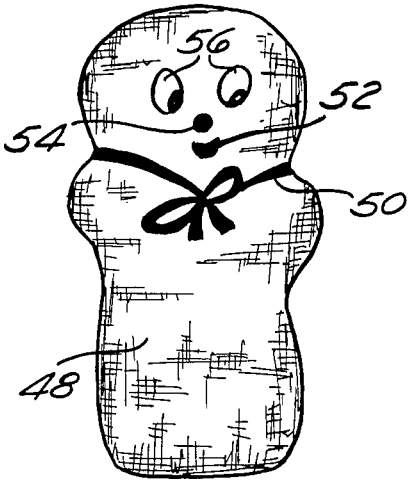
Fig. 6
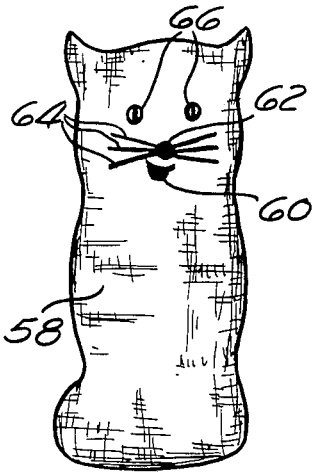
Fig. 7
Fig. 8
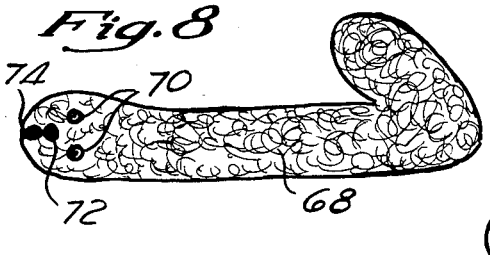
Fig. 9
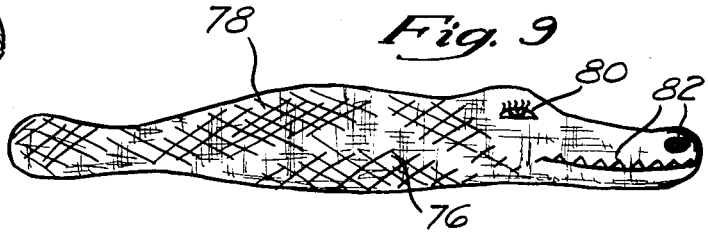
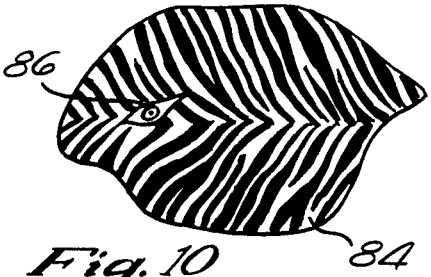
Fig. 10
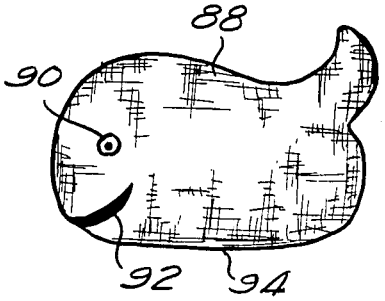
Fig. 11
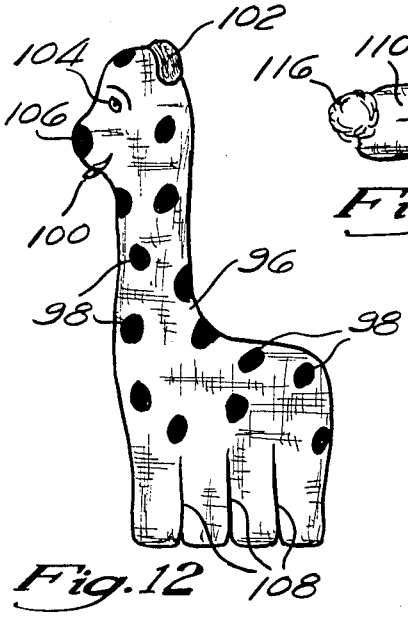
Fig. 12
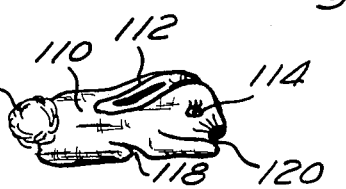
Fig 13
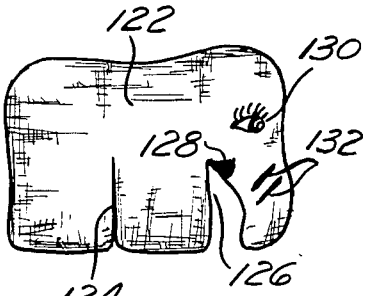
Fig. 14
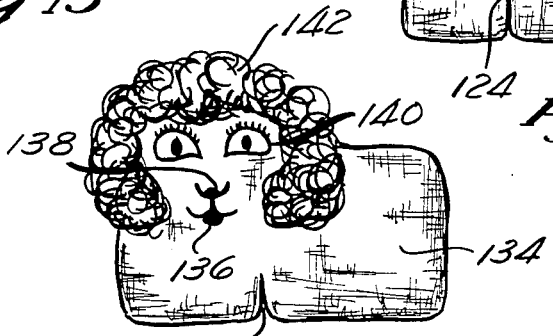
Fig. 15

Fig. 16
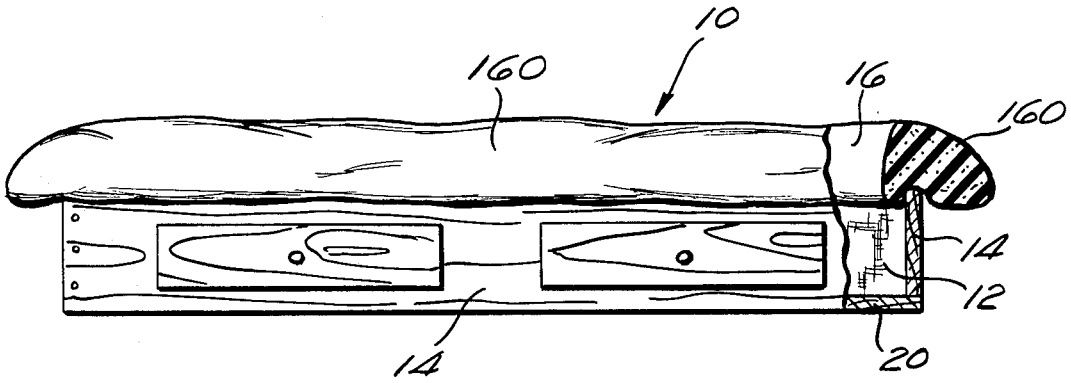
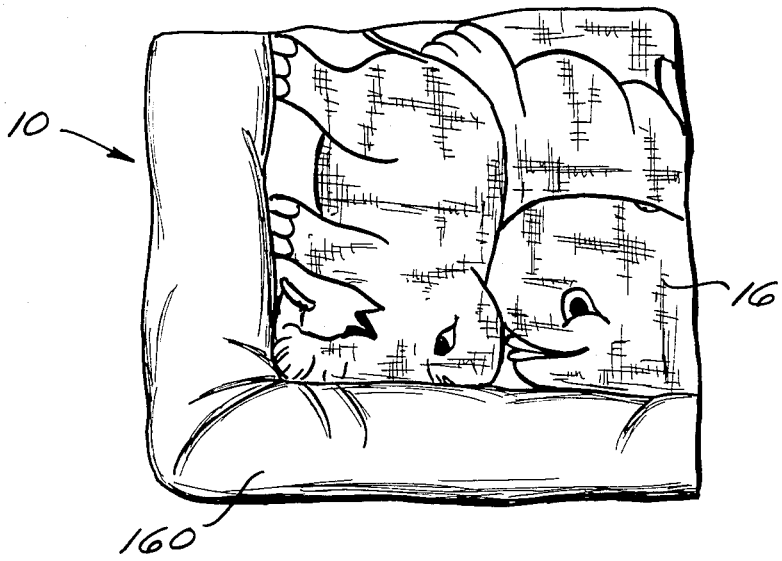
Fig. 17

BED AND MATTRESS FORMED BY ANIMAL SHAPED NESTING PLAY CUSHIONS

BRIEF SUMMARY OF THE INVENTION, BACKGROUND AND OBJECTIVES

My invention relates to a bed primarily appealing to children in which the mattress is formed by a multiplicity of pillows in the from of symbols such as animal outlines.

Children historically have played with dolls and, particularly in more modern times, children have enjoyed playing with stuffed objects representing animals, one of the earliest and favorites being teddy bears. I conceived the idea of a bed appealing particularly to children for the same reasons that dolls and stuffed animals appeal to them and it is an objective of my invention to provide in a bed a substitute for a mattress formed by a multiplicity of pillows shaped as symbols of animals and the like.

Children like to play with stuffed animals in the same manner as dolls, to cuddle the same, and otherwise use the same. I further conceived the idea of dividing the animal symbols in the mattress of the bed so that they can be separately removed, played with, and returned when the child goes to bed. It is a further object of my invention to provide individual separate removement and replacement capability in pillows forming such a mattress.

Additional objectives include: (a) to provide on the horizontal body supporting the mattress a set of markings outlining the arrangement of the pillows in designed dispositions, to show the person replacing them how they fit, (b) to provide the pillows with appropriately colored and decorated covers representative of the animal and other symbols, and (c) to provide other objectives and desirable features in a bed of this type with due regard to economy and practicality.

My invention will be best understood, together with additional advantages and objectives thereof, when read with reference to the drawings.

THE DRAWINGS

FIG. 1 is a perspective view of a bed forming a specific embodiment of my invention. A matching spread, partly folded up, is shown on the right.

FIG. 2 is an enlarged perspective view on one of the pillows forming the mattress in the bed. The pillow is in a form symbolizing an elephant. Portions are broken away to show a foam pad and an inner ticking on the foam pad.

FIGS. 5–15 are individual top views of the pillows shown in the other figures.

FIG. 16 is a side view, with portions broken away, of a modified bed with a rectangular or frame-like bolster disposed above the bed side frames.

FIG. 17 is a plan veiw of one corner of the bed viewed in FIG. 16.

DESCRIPTION

Figure 1:
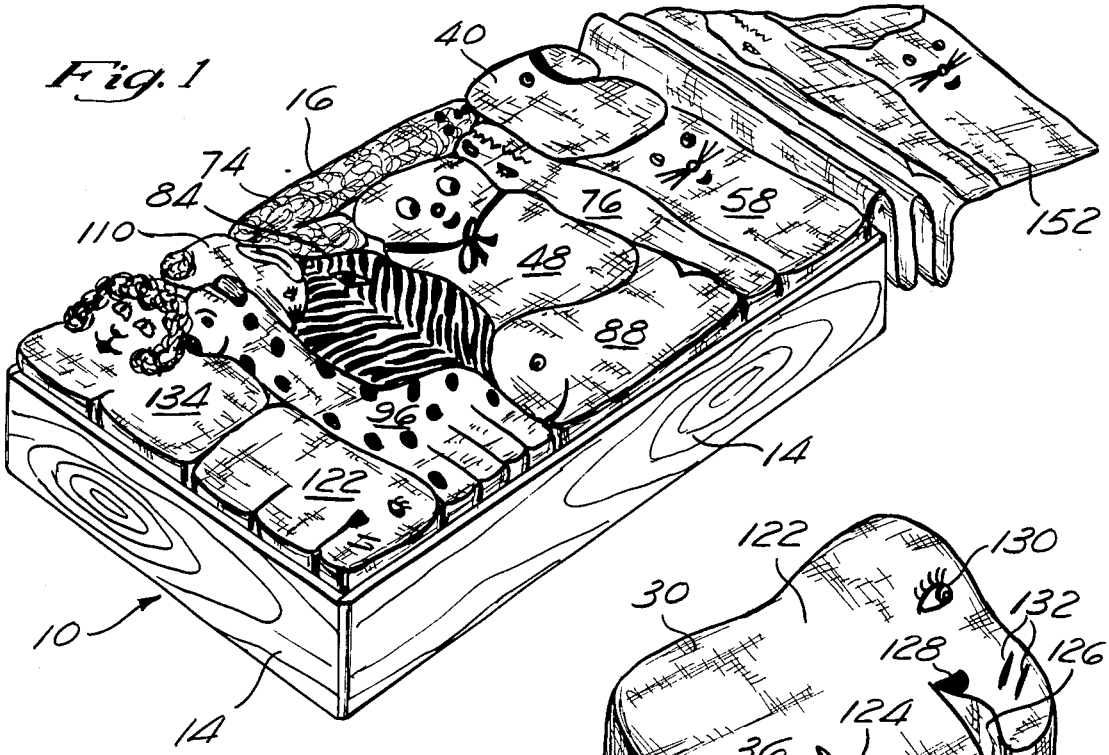
Figure 3:
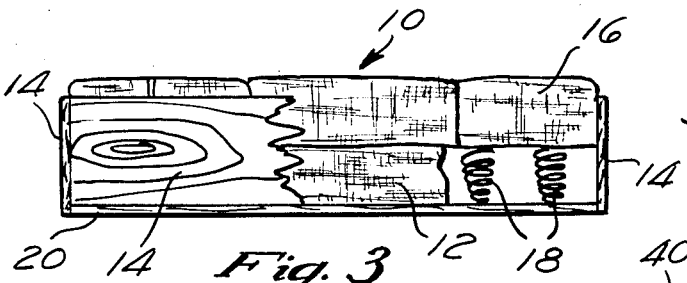
FIG. 3 is a side view, with portions broken away.
Figure 4:
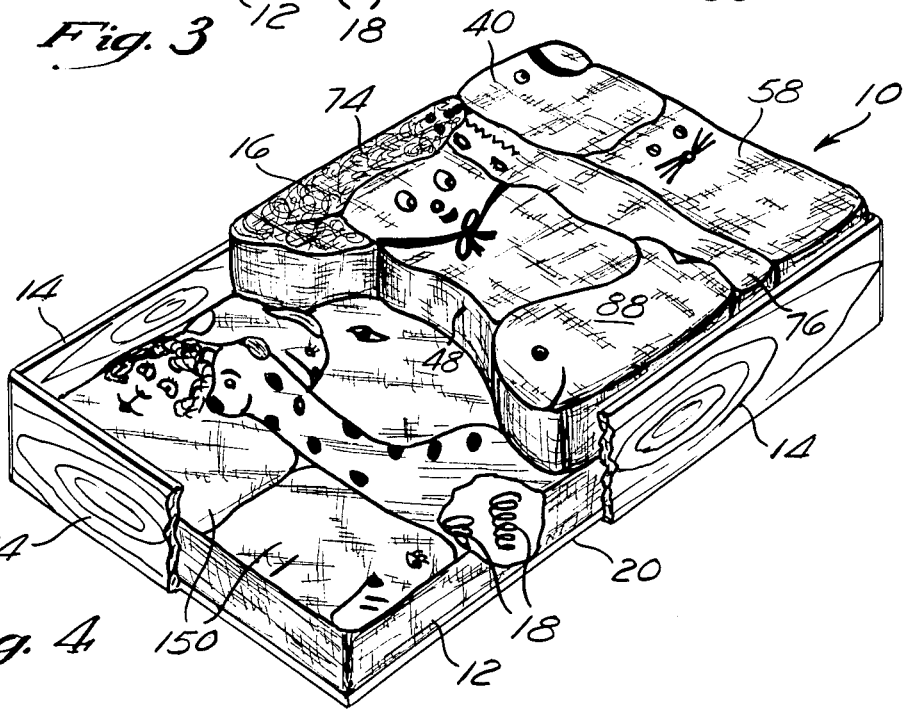
FIG. 4 is a view like FIG. 1 but with some of the pillows and side frames removed to reveal otherwise concealed structure.

FIGS. 1, 3 and 4 ar general views of bed 10 which has three primary components: a horizontal supporting body 12, vertical side frames 14 and a generally rectangular mattress 16. The bed often will have legs but as this is an optional and conventional feature I have not illustrated them.

I have indicated that horizontal supporting body 12 is a set of box springs by the showing of springs 18 in FIGS. 3 and 4. A foam plastic pad could be substituted for box springs. Whereas a solid board bottom 20 is indicated under frames 14, slats or the like could be substituted as normally a set of springs 18 only requires slats for support.

Note the plane of the top of the mattress 16 is preferably spaced an inch or two above the plane of the top of frames 14. This is for two reasons: (a) to be more comfortable when one sits on the edge of the bed and (b) to protect the user against striking the sharp edge of the top of frames 14 when roughousing.

Mattress 16 is formed by a multiplicity of pillows. For the purpose of the claims I have selected the expression "a multiplicity of at least six" pillows with the idea that at least that many pillows would be needed to gain the effect I am after.

In the illustration in the drawings, eleven different types of pillows are shown.

The pillows are separate, divided, juxtaposed and individually removable. Their sides are preferably generally abutted together to form mattress 16 in a substantially continuous body. Preferably the pillows are formed in a manner of a cushion in the upholstery art. In other words, commonly the pillows will be cut from a foam pad with straight parallel sidewalls. This boxed configuration often is termed a "cushion" and is the type of upholstery in which commonly seams are formed at the upper and/or lower corners to gain a boxed appearance. However, a loose pillow filling could be used and pillow shapes could have generally curved sides in the manner often found in occassional pillows.

In the preferred construction, the pillows in plan view have outlines forming meaningful symbols, such as animal outlines, in which the figures are configured to interfit on irregular, usually curved lines, so that preferably there will be no appreciable space between animals. The substantially continuous surface is both for comfort and for ornamental effect, although if the manufacturer prefers, there could be perceptible spaces such as small triangles between sections of adjacent animals. FIGS. 1 and 4 illustrate that the pillows are generally abutted together and form a substantially continuous body and at least about half of the sides of the pillows form outlines curving in plan view and generally interfitting on curved lines of abutment so as to generally maintain contact between the curved outlines. This could be called a jigsaw puzzle in effect, except there are basically two types of jigsaw puzzles, one like this in which parts are bent on curved lines but are not interlocked and a second type in which the jigsaw puzzle pieces interlock against separation in a sidways direction. It is not the intention in the embodiment shown in the drawings to be interlocked in the second form of jigsaw puzzles. However, one purpose of side frames 14, which lap the sides of the body 12 and the sides of mattress 16, is to maintain the pillows in position. I have also secured the pillows in place with Velcro hook fastener strips, in which the Velcro hook fastener strips secure the pillows to the body 12 or to each other. Although that is a possibility, that is not the design shown in the drawings because the pillows will be more comfortable for children to play with if they do not have Velcro strips, which feel rather abrasive.

Meaningful symbols can be clearly represented by the pillows and can be imaginatively formed, as shown in the drawings, but still generally interfit. Some attractive or imaginative results are gained by the requirement of modification of form to gain interfitting and abutment. Children are used to modification of animal shapes and the like in cartoons, pictures, stuffed animals, etc., and readily "read" the animal being symbolized despite considerable modification of outlines from those actually found in nature.

Each pillow in plan view preferably has an outline forming a meaningful symbol by itself. The majority of the symbols are animals. By the words "meaningful symbol" I mean shapes that can be named such as animals that are part of our culture. The snowman is an example of a meaningful symbol that is not an animal. I do not mean to exclude such meaningful symbols as geometrical figures, i.e., stars, circles, elipses, etc. Free forms possibly could be used but particularly younger children usually will prefer traditional animal symbols.

Preferably the pillows will have removable covers 30 secured with zippers 32 and preferably will be formed from foam blocks cut with straight, parallel vertical sides configuring bodies 34 filling pillow covers 30. Further, for protection of foam bodies 34 and to avoid soiling of them and particularly for ease of insertion into covers 30, ticking covers 36 preferably are provided and are sewn in place around foam pads 34.

The way the meaningful symbols are formed by the pillows is (a) by the exterior outline in plan view of the pillow and (b) by the color and decoration of covers 30. In the claims I've used the expression that the covers are "representatively colored and decorated to represent the symbols related thereto". This expression will be understood by those skilled in the art. For examples, a cow shape will usually be given a cow color of red, tan, black and white, etc., but that is not to exclude the possibility of a purple cow. To some extent, like in the case of the purple cow, a color not native to the animal will be used, but children usually will read this as representing the animal by other clues such as the general shape or other decorations on the animal. Children exposed to television, movies, comics, children's books, etc., are used to imaginative animal shapes, colors and details, some following natural animals closely and others running rather counter to nature, i.e., purple coloring on a cow, clothing on a mouse (Mickey Mouse), major changes in physical features (Mickey Mouse), etc.

I will now discuss the pillows illustrated individually in Figures 2 and 5–15. FIG. 5 has a parrot-shaped pillow 40, meaning the pillow is enough like a parrot to be recognized between its outline in plan view and its color and decoration. In a prototype the body cover was blue-green and the beak has a red inner segment 42 and a yellow outer segment 44. The eye 46 had a yellowish outer part and a dark center. The parrot shape interfits on curved lines with a cat shape, an alligator shape, and a worm shape.

So called "decorations" on the pillows can be features like eyes, noses, tongues, whiskers, etc. They can be silk-screened or otherwise directly colored onto fabric. In a higher-priced construction, such as used in the prototype, these decorative features are added on by pieces of felt, yarn, ribbon, etc., sewn or bonded in place. Preferably, botton-like hard objects are avoided, even for eyes 42, etc., where they would be apt in appearance, because of danger a child might swallow or even choke on detached buttons and the like. Therefore, it is preferred that eyes 42 be formed from inner and outer pieces of felt or other fabric.

Pillow 48 has an outline symbolizing a snowman and has a cover formed of white fuzzy material. A red ribbon 50 is tied around the neck. A red piece 52 forms a mouth, a black piece 54 forms a nose, and the eyes 56 are black and white. Snowman 48 has curved sides that interfit with adjoining pillows.

Pillow 58 in the prototype was formed with a cat outline, had a black cover, had a red tongue 60, had a green nose 62, had white whiskers 64, and had eyes 66 with light blue outsides and black centers. Two sides of cat 58 curvedly interfit with parrot 40 and an alligator shape.

Pillow 68 has an outline representing a worm but instead of being given a slick finish it was given counter treatment in the prototype with a shaggy violet cover. Eye and mouth decorations 70, 72 were black and a felt red tongue 74 was attached in the manner of a tag.

Pillow 76 has an outline representing an alligator. In the prototype the cover was pale aqua and a few black crossed lines of threads 78 represented a rough alligator skin. The eye 80 included red portions. Teeth and nostril 82 were black. The irregularly curved long sides of the alligator shape interfit with parrot, cat, whale and snowman pillows.

Pillow 84 has an outline representing a zebra fish. In the prototype, zebra-patterned material was procured in black and white for the pillow cover. The eye 86 has a red outer part and a yellow center, both made of felt. All sides of fish 84 curvedly interfit with worm, snowman, whale, giraffe and rabbit.

Pillow 88 has a contour "readable" as a whale. In the prototype a purple fabric cover was used. The eye 90 had a yellow outside and a black center. A sewn reddish line 92 represented a mouth. Three sides of pillow 88 curvedly interfit with alligator, snowman, zebra fish, and giraffe. As with other pillows abutting side frames 14, it is possible to give the side 94 abutting side frame 14 limited but interacting curvature at least when separated from bed 10 and not pressed against a side frame 14.

Pillow 96 has an outline representing a giraffe. Fabric may be procurred for the pillow cover reproducing giraffe spots 98 and coloring. In the prototype, pillow 96 was further decorated by a red tongue 100, a yellow "tag" ear 102, and eye 104 with a yellow outer part and a dark inner part, and a black nose 106. Lines 108 representing legs can either be sewn lines or the like or can be divisions of pad, ticking and cover in the same manner legs and trunk are formed in the elephant in FIG. 2. Three sides of pillow 96 curvedly interfit with other pillows.

Pillow 110 has an outline representing a rabbit. The pillow cover in the prototype was brown, ear 112 has a red central part, and the outer part of eye 114 was pink. Sewing of the cover fabric represented the ear 112, the tail 116 and the feet indentations 118, 120. The rabbit interfits with the worm, zebra fish, giraffe and lion.

Figure 2:
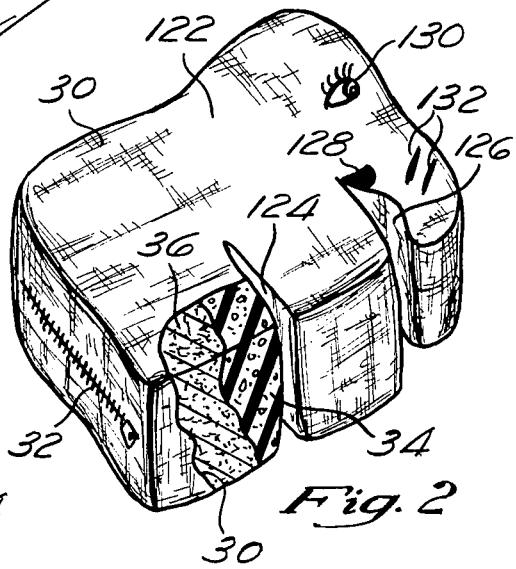

Pillow 122 has an outline representing an elephant. The fabric used in the prototype was grey. FIG. 2 shows a feature of the elephant pillow in which legs and trunk are defined by divisions 124, 126 of the pillow cover, and foam pad extending from one edge inwardly. This is an attractive feature that can be used to make some of the pillow symbols more attractive, although at some expense. For example, legs on giraffe and lion figures can be partly defined similarly to the construction of Figure 2.

The elephant pillow 122 also has a red felt tongue 128, an orchid eye 130 with a black outline and center, and a couple of black lines of stitching 132 suggesting wrinkling of the trunk.

The outline of pillow 134 suggests a lion. In the prototype, a yellow-green fluffy material was used for its cover. The mouth 136 was red in its center and other line details 138 defining the mouth and nose were black. The eyes 140 were orange with brown centers. The mane 142 was formed by orange, white and black lengths of yarn. A division 144 of the pillow material from the bottom edge suggests legs.

A guide is needed for replacement of the pillows forming mattress 16 and FIG. 4 indicates this has the form of markings 150 on the upper surface of horizontal supporting body 12. The markings can just give outlines, can give outlines and other decorative features, and can include color, depending on the choice of the designer. The design 150 could be silk-screened onto the material forming the top of body 12. It will be observed from FIG. 4 that the design markings 150 give a guide for rapid replacement of the pillows.

Another desirable feature, although optional, shown in FIG. 1, is a spread 152 matching the design of the pillows in mattress 16. This could be a single panel of material in which the design is silkscreened in general outlines, color and details or spread 152 could be quilted from a number of pieces representing the various figures, in which case types and colors of materials matching the pillow covers could be used in whole or in part.

FIGS. 16 and 17 illustrate a modification in which a rectangular or frame-like padded bolster 160 is provided about mattress 16. Bolster 160 provides a soft, pillow-like finish to the entire ensemble. On a practical level, the bolster cushions the top of frame members 14 to protect children from striking frames in falling. Bolsters 160 can be filled with foam or other padding.

Having thus described my invention, I do not wish to be understood as limiting myself for the exact construction shown and described, Instead, I wish to cover those modifications of my invention that will occur to those skilled in the art upon learning of my invention and which are within the proper scope thereof.

I claim:

1. A bed comprising:

(a) a horizontal supporting body and vertical side frames lapping the sides of said body and extending thereabove and forming a rectangle thereabout and a generally rectangular mattress resting on and generally completely covering said supporting surface and generally completely filling the space between said side frames, (b) said mattress being formed by a multiplicity of at least six separate, divided, individually removable, juxtaposed, pillows having their sides generally abutted together to form said mattress in a substantially continuous body, at least about half of the sides of said pillows forming outlines curving in plan view and generally interfitting on curved lines of abutment so at to generally maintain contact between the curved outlines, (c) each pillow in plan view forming a meaningful symbol by its outline, the majority of said symbols being animals and the pillows having covers representatively colored and decorated to represent the symbols related thereto, and (d) the upper surface of said horizontal supporting body having markings outlining the arrangement of the outlines of said pillows so as to guide the user in restoring the arrangement of said pillows in designed dispositions.

2. A bed comprising:

(a) a horizontal supporting body and vertical side frames lapping the sides of said body and extending thereabove and forming a rectangle thereabout and aa generally rectangular mattress resting on and generally completely covering said supporting surface and generally completely filling the space between said side frames, (b) said mattress being formed by a multiplicity of at least four separate, divided, individually removable, juxtaposed pillows having their sides generally abutted together to form said mattress in a substantially continuous body, (c) each pillow in plan view forming a meaningful symbol by its outline, the majority of said symbols being animals and the pillows having covers decorated to represent the symbols related thereto, at least about half of the sides of said pillows forming outlines bending in plan view, to form animal irregular outlines, and generally interfitting on bent lines of abutment so as to generally maintain contact between bent outlines and (d) the upper surface of said horizontal supporting body having markings outlining the arrangement of the outlines of said pillows so as to guide the user in restoring the arrangement of said pillows in designed dispositions.

3. A bed comprising:

(a) a horizontal supporting body and vertical side frames lapping the sides of said body and extending thereabove and formng a rectangle thereabout and a generally rectangular mattress resting on and generally completely covering said supporting surface and generally completely filling the space between said side frames, (b) said mattress being formed by a multiplicity of at least six separate, divided, individually removable, juxtaposed pillows having their sides generally abutted together to form said mattress in a substantially continuous body, and (c) each pillow in plan view forming a meaningful symbol by its outline, the majority of said symbols being animals and the pillows having covers colored and decorated to represent the symbols related thereto, at least about half of the sides of said pillows forming outlines curving in plan view, to form animal irregular outlines, and generally interfitting on curved lines of abutment so as to generally maintain contact between the curved outlines.

4. The subject matter of claim 3 in which there is a quilted spread reproducing the pattern of the symbols of said pillows.

5. A bed comprising:

(a) a horizontal supporting body and vertical side frames lapping the sides of said body and extending thereabove and forming a rectangle thereabout and a generally rectangular mattress resting on and generally completely covering said supporting surface and generally completely filling the space between said side frames, (b) said mattress being formed by a multiplicity of at least four separate, divided, individually removable, juxtaposed pillows having their sides generally abutted together to form said mattress in a substantially continuous body, (c) each pillow in plan view forming a meaningful symbol by its outline, the majority of said symbols being animals and the pillows having covers decorated to represent the symbols related thereto, at least about half of the sides of said pillows forming outlines bending in plan view, to form animal irregular outlines, and generally interfitting on bent lines of abutment so as to generally maintain contact between bent outlines.

6. The subject matter of claim 5 in which the decorations include representative colors of animals and include representations of features including eyes, ears, mouths and tongues and include pieces fastened to said covers for representation of at least part of said features.

* * * * *